US006041628A

United States Patent [19]

Lin

[11] Patent Number: 6,041,628

[45] Date of Patent: Mar. 28, 2000

[54] MAGNETIC KEY LOCK ASSEMBLY

[75] Inventor: Zhong Zhe Lin, Quang Dong, China

[73] Assignees: Hua Ye Lin; Lincoln Tsai, both of El Monte, Calif.

[21] Appl. No.: 09/374,479

[22] Filed: Aug. 13, 1999

[51] Int. Cl.[7] ..... E05B 47/00

[52] U.S. Cl. ..... 70/276; 70/388; 70/413

[58] Field of Search ..... 70/276, 388, 413, 70/414, 493

[56] References Cited

U.S. PATENT DOCUMENTS

| | | | |
|---|---|---|---|
| 2,648,729 | 8/1953 | Noregaard | 70/413 |
| 3,393,541 | 7/1968 | Wake | 70/276 |
| 3,408,837 | 11/1968 | Felsou | 70/276 |
| 3,566,637 | 3/1971 | Hallmann | 70/276 |
| 3,584,484 | 6/1971 | Hallmann et al. | 70/276 |
| 3,661,001 | 5/1972 | Glass | 70/388 |
| 3,995,463 | 12/1976 | Mikos | 70/388 |
| 4,748,834 | 6/1988 | Herriott | 70/413 |

FOREIGN PATENT DOCUMENTS

| | | | |
|---|---|---|---|
| 815792 | 6/1969 | Canada | 70/276 |
| 2251686 | 7/1973 | Germany | 70/388 |
| 1131350 | 10/1968 | United Kingdom | 70/388 |
| WO 80/01586 | 8/1980 | WIPO | 70/276 |

*Primary Examiner*—Lloyd A. Gall
*Attorney, Agent, or Firm*—Raymond Y. Chan; David and Raymond

[57] ABSTRACT

A magnetic lock assembly includes a magnetic lock cylinder for actuating a latch assembly, wherein the magnetic lock cylinder including a lock sleeve having an axial rotor hole and a plurality of tumbler sockets radially distributed on an inner surface of the lock sleeve; a plurality of magnet tumblers, each of which has a north pole and a south at two ends respectively, being coaxially placed in the tumbler sockets respectively; a tubular lock rotor being rotatably and coaxially fitted in the axial rotor hole of the lock sleeve, the lock rotor having an axial through hole and a plurality of locking holes radially distributed through a rotor wall thereof; a locker tube being fittedly disposed inside the axial through hole of the lock rotor to define a keyway therethrough; a magnetic key including a round key body having a plurality of magnet sockets provided around the key body corresponding to the axial and radial positions of the magnet tumblers in the magnetic lock cylinder respectively, and a plurality of pill shaped magnets affixed in the magnet sockets respectively.

12 Claims, 3 Drawing Sheets

MAGNETIC KEY LOCK ASSEMBLY

FIELD OF THE PRESENT INVENTION

The present invention relates to lock and key, and more particularly to a magnetic key lock assembly comprising a magnetic lock cylinder associated with a magnetic key to provide more locking permutations and combinations.

BACKGROUND OF THE PRESENT INVENTION

The conventional lock and key assembly, such as barrel lock, utilizes specific engagement or disengagement between a plurality of pin-tumblers in the lock cylinder and the key's serrations correspondingly to control the locking and unlocking functions thereof.

Virtually all mechanical locking devices are subject to tampering, possibly resulting from loss of keys, duplication of keys, and picking due to its limited mechanical structure and theory. Moreover, although many types of locking devices which are magnetically actuated or controlled are known in arts, they all bear a common drawback of failing to ensure all the magnet tumblers precisely returning to their locking position when the key is withdrawn from the keyway. Such unsolved problem is the main reason of why the magnetic lock cannot be commonly on sale in market and broadly utilized by the consumers.

SUMMARY OF THE PRESENT INVENTION

The main object of the present invention is to provide a magnetic key lock assembly which avoids the drawbacks of easy picking and key duplicating of the conventional mechanical lock and key assembly by eliminating the serrations of the keys with a simply rod liked magnetic key to associate with a mechanical lock cylinder by fitting into a circular keyway thereof.

Another object of the present invention is to provide a magnetic key lock assembly, wherein the arrangement of the magnet tumblers, which is not limited to one or two opposing rows as in the mechanical lock and key assembly, can include any possible number of tumblers aligned around anywhere of the entire cylindrical surfaces of the key and keyway correspondingly, so that the present invention can provide more locking permutations and combinations to ensure the security function of a lock.

Another object of the present invention is to provide a magnetic key lock assembly, wherein all the magnet tumblers inside the magnetic lock cylinder will be guided to rapidly and precisely return to their locking positions once the magnetic key is withdrawn from the keyway of the magnetic lock cylinder.

Another object of the present invention is to provide a magnetic key lock assembly, wherein all the magnet tumblers inside the magnetic lock cylinder will be guided to rapidly and precisely radially move to their unlocking positions once the magnetic key is inserted into the keyway of the magnetic lock cylinder.

In order to accomplish the above objects, the present invention provides a magnetic key lock assembly, comprising:

a magnetic lock cylinder for actuating a latch assembly, wherein the magnetic lock cylinder comprises a lock sleeve, made of non-magnetic material such as brass, having an axial rotor hole and a plurality of tumbler sockets radially distributed on an inner surface of the lock sleeve;

a plurality of magnet tumblers, each of which has a north pole and a south at two ends respectively, being coaxially placed in the tumbler sockets respectively, wherein each of the magnet tumblers must be equal to or shorter than the respective tumbler socket of the lock sleeve;

a tubular lock rotor, made of non-magnetic material, being rotatably and coaxially fitted in the axial rotor hole of the lock sleeve, the lock rotor having an axial through hole and a plurality of locking holes radially distributed through a rotor wall thereof, wherein the locking holes are able to be coaxially aligned with the tumbler sockets respectively and each of the locking holes has a depth shorter than a length of the respective magnet tumbler; and a locker tube, made of magnetic conducting material such as iron and steel, being fittedly disposed inside the axial through hole of the lock rotor to define a keyway therethrough, wherein the locker tube is adapted for attracting the magnet tumblers inside the rotor hole to move inwardly towards the locking hole until an inner portion of each of magnet tumblers is disposed in the respective locking hole and an outer portion of each of the magnet tumblers is disposed in the respective rotor socket so as to lock up the rotatable movement between the lock rotor and the lock sleeve; and a magnetic key comprising a key body having a plurality of magnet sockets provided around the key body corresponding to the axial and radial positions of the magnet tumblers in the magnetic lock cylinder respectively, and a plurality of pill shaped magnets affixed in the magnet sockets respectively, wherein an outer end of each of the magnets has a magnetic pole equal to the magnet pole of the respective magnet tumbler, so that when the magnetic key is insert into the keyway, the magnet tumblers are repelled radially outward into the tumbler sockets correspondingly, so as to unlock the magnetic lock cylinder to enable the lock rotor freely rotating to control the locking and unlocking of the latch assembly.

The key body can be a shape of rod-liked or flat unless it can carry numbers of arranged magnets and provide the magnetic field in order to unlock the lock cylinder.

DETAILED DESCRIPTION OF THE PREFERRED EMBODIMENT

Figure 1:
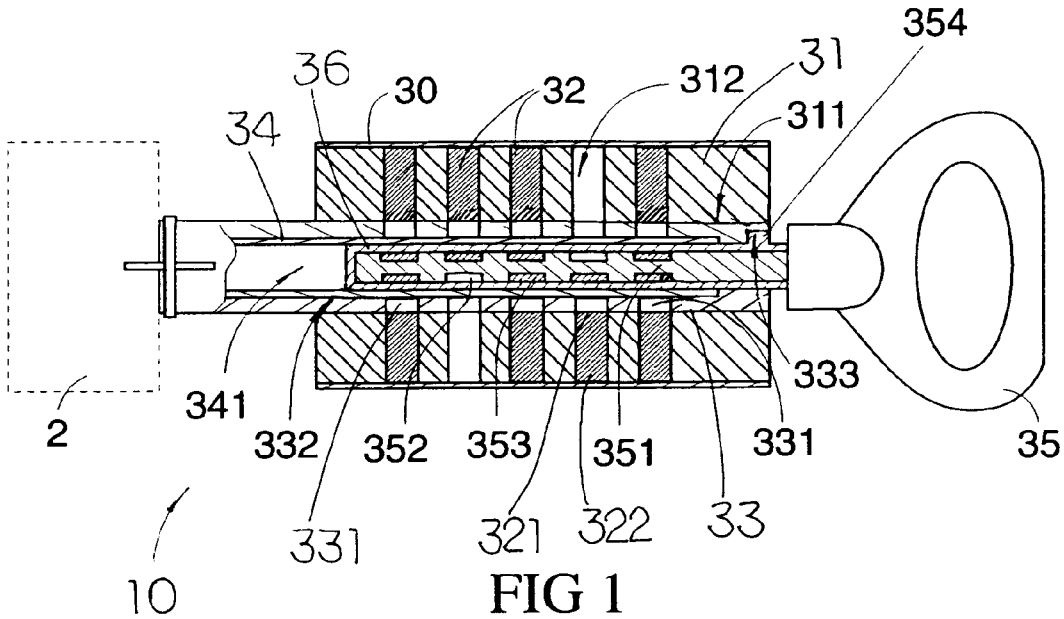
FIG. 1 is a sectional front view of a magnetic key lock assembly according to a first preferred embodiment of the present invention.
Figure 2:
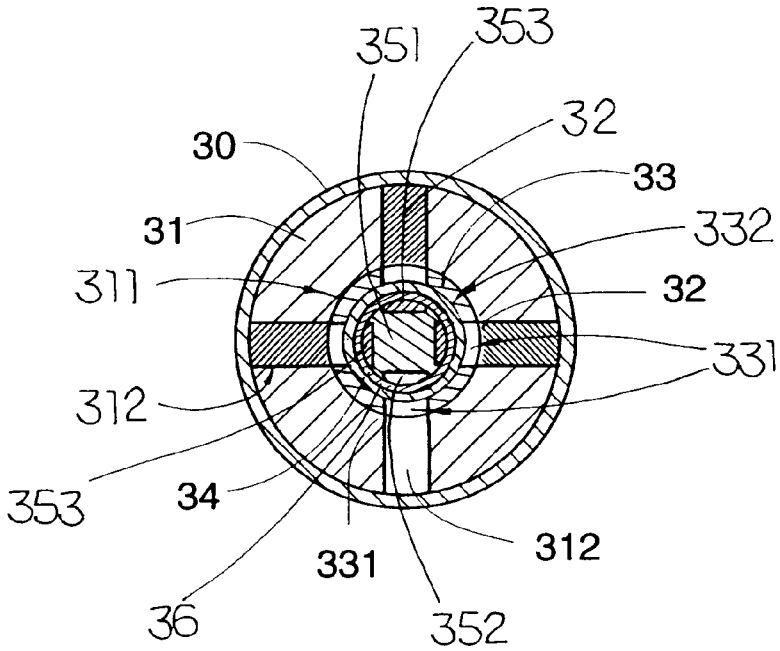
FIG. 2 is a sectional end view of the magnetic key lock assembly according to the above first preferred embodiment of the present invention.

Referring to FIGS. 1 and 2 of the drawings, a magnetic lock assembly 10 according to a first preferred embodiment of the present invention is illustrated. The magnetic lock assembly 10 comprises a magnetic lock cylinder 30 adapted for actuating a latch assembly 2 and a magnetic key 35.

The magnetic lock cylinder 30 comprises a lock sleeve 31, a plurality of magnet tumblers 32, a tubular lock rotor 33, and a locker tube 34.

The lock sleeve 31 ,which is made of non-magnetic material such as brass, has an axial rotor hole 311 and a plurality of tumbler sockets 312 radially distributed on an inner surface of the lock sleeve.

The plurality of magnet tumblers 32, each of which has a north pole 321 and a south pole 322 at two ends respectively, are coaxially placed in the tumbler sockets 312 respectively, wherein each of the magnet tumblers 32 must be equal to or shorter than the respective tumbler socket 312 of the lock sleeve 31.

The tubular lock rotor 33, which is made of non-magnetic material, is rotatably and coaxially fitted in the axial rotor hole 311 of the lock sleeve 31, the lock rotor 33 having an axial through hole 332 and a plurality of locking holes 331 radially distributed through a rotor wall thereof, wherein the locking holes 331 are able to be coaxially aligned with the tumbler sockets 312 respectively and each of the locking holes 331 has a depth shorter than a length of the respective magnet tumbler 32.

The locker tube 34, which is made of magnetic conducting material such as iron and steel, is fittedly disposed inside the axial through hole 332 of the lock rotor 33 to define a keyway 341 therethrough, wherein the locker tube 34 is adapted for attracting the magnet tumblers 32 inside the rotor hole 311 to move inwardly towards the locking hole 331 until an inner portion of each of magnet tumblers 32 is disposed in the respective locking hole 331 and an outer portion of each of the magnet tumblers 32 is disposed in the respective tumbler socket so as to lock up the rotatable movement between the lock rotor 33 and the lock sleeve 31.

The magnetic key 35 comprises a round rod shaped key body 351 which has a plurality of magnet sockets 352 provided around the key body 351 corresponding to the axial and radial positions of the magnet tumblers 32 in the magnetic lock cylinder 30 respectively, and a plurality of pill shaped magnets 353 affixed in the magnet sockets 352 respectively. An outer end of each of the magnets 353 has a magnetic pole equal to the magnetic pole of the respective magnet tumbler 32, so that when the magnetic key 35 is inserted into the keyway 341, the magnet tumblers 32 are repelled radially outward into the tumbler sockets 312 correspondingly, so as to unlock the magnetic lock cylinder 30 to enable the lock rotor 33 freely rotating to control the locking and unlocking of the latch assembly 2.

The magnetic key 35 further comprises an exterior cover tube 36 to securely and entirely cover the key body 351 therein coaxially, so that the locations of all the magnets 353 affixed on the magnet sockets 352 is hidden from outside observation for security purpose. In fact, although each magnetic key 35 can only operate a corresponding magnetic lock cylinder 30, all magnetic keys 35 may have an identical appearance of merely a round rod. The user may simply use color or other indications to distinguish the keys of different locks easily.

Moreover, each of the magnet tumblers and the respective magnet 353 should be coaxially aligned in a perpendicular manner with the axis of keyway 341 of the magnetic lock cylinder 30.

An open end of the lock rotor 30 has a locating groove 333 formed thereon. A locating latch 354 is outwardly protruded from an inner end of the key body 351 of the magnetic key 35, which is adapted to serve not only locating the magnets 353 inside the magnetic key 35 corresponding to the magnet tumblers 32 in the magnetic lock cylinder 30 but also predetermining the length of the magnet key 35 should be inserted into the keyway 341. Moreover, the locating latch 354 inserting into the locating groove 333 serves for easy rotation of the lock rotor 33 while in an unlocking condition.

The operation of the magnetic lock assembly 10 is all about the magnet field. A predetermined combination of the magnet tumblers 32 is located at the respective locking hole 331. It means that the location and the pole (the north and the south pole) of the magnet tumbler 32 can be selected and placed on the locking hole 331. This arrangement of the magnet tumbler 32 is set as a locking code for the magnetic lock assembly 10. If the magnetic key 35 has the corresponding arrangement and pole of the magnet 353 on the key body 351, the magnetic key 35 is adapted for unlocking the lock rotor 33. When the magnetic key 35 is inserted into the respective lock cylinder 30, because of the magnetic properties of "like poles attract, unlike poles repel", the magnet tumblers 32 are repelled by the respective magnet 353 on the magnetic key 35 radially outward into the tumbler sockets 312 correspondingly, so as to unlock the magnetic lock cylinder 30 to enable the lock rotor 33 freely rotating to control the locking and unlocking of the latch assembly 2. When the magnetic key 35 is pulled out of the keyway 341, the magnetic field disappears and the isolated magnet tumblers 32 will be attracted by the conductive locker tube 34 and returned to their original arranged locking holes 331 in such a lock-up position.

Otherwise, if the magnetic key 35 is inserted into a non-corresponded lock cylinder 30, which one of the magnet 353 inside the key 35 is in different arrangement or has an unlike pole to the magnet tumbler 32, the magnet tumbler 32 is either sat or force to stay on locking hole 331 of the lock rotor 33 because of the attractive force of the unlike poles. So, the magnet tumblers 32 act as a latch to lock the rotation of the lock rotor 33 and keep in the locking condition. Accordingly, the more the magnet tumbler 32 placed in the lock cylinder 30, the more the security of the magnetic lock assembly is. It is because when the number of magnet tumbler 32 placed in the lock cylinder 30 increases, the more combination of the locking code is received.

Figure 3:
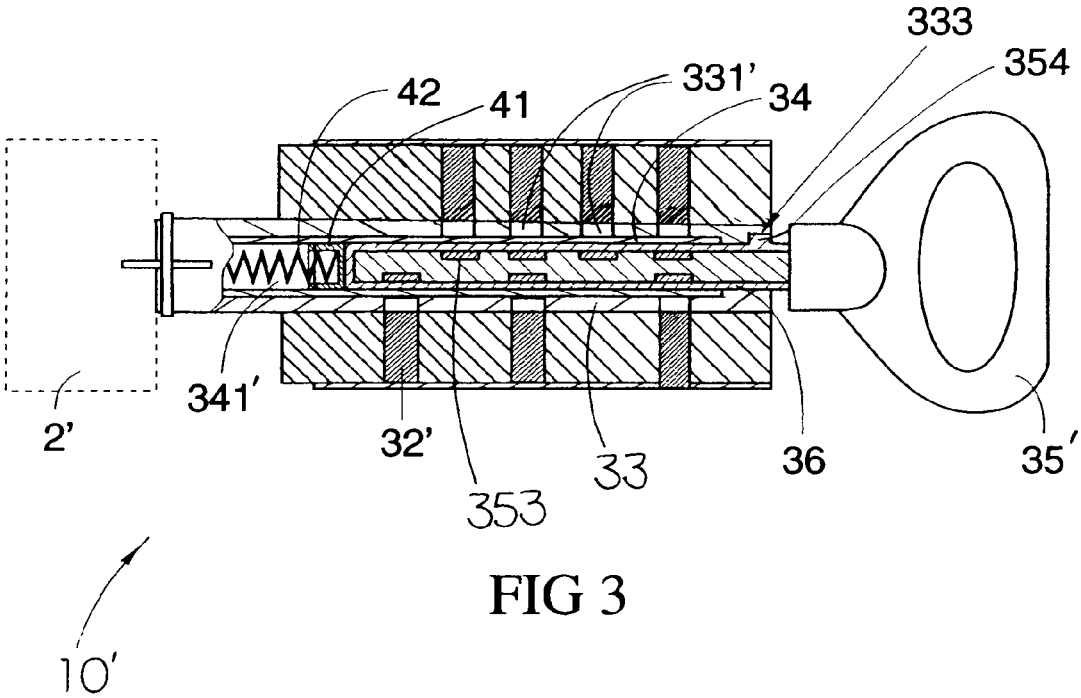
FIG. 3 is a sectional front view of a magnetic key lock assembly when the magnetic key is inserted into the circular keyway according to a second preferred embodiment of the present invention.
Figure 4:
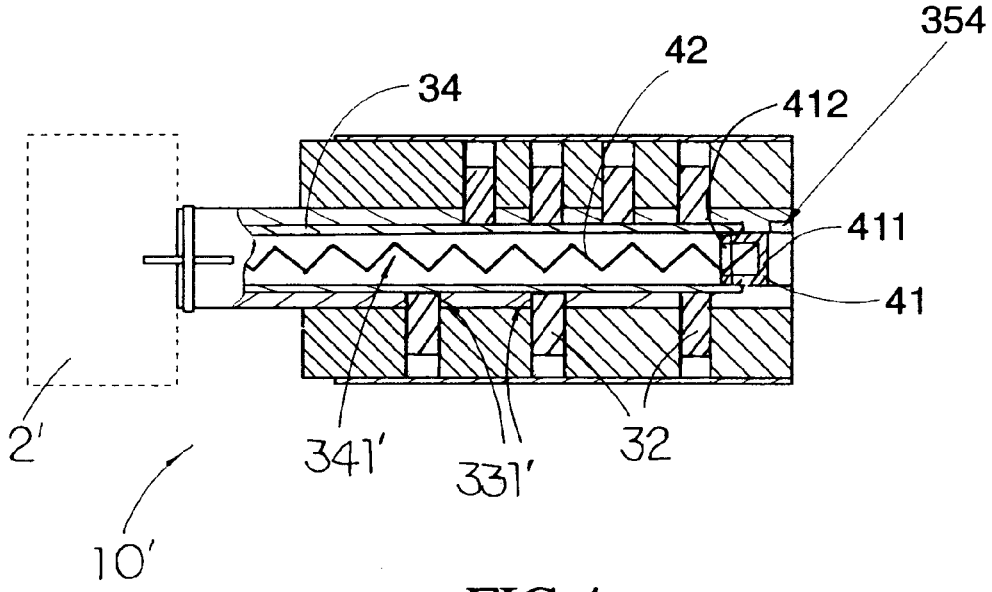
FIG. 4 is a sectional front view of an empty magnetic lock cylinder of the magnetic key lock assembly without the magnetic key in the circular keyway thereof according to the above second preferred embodiment of the present invention.
Figure 5:
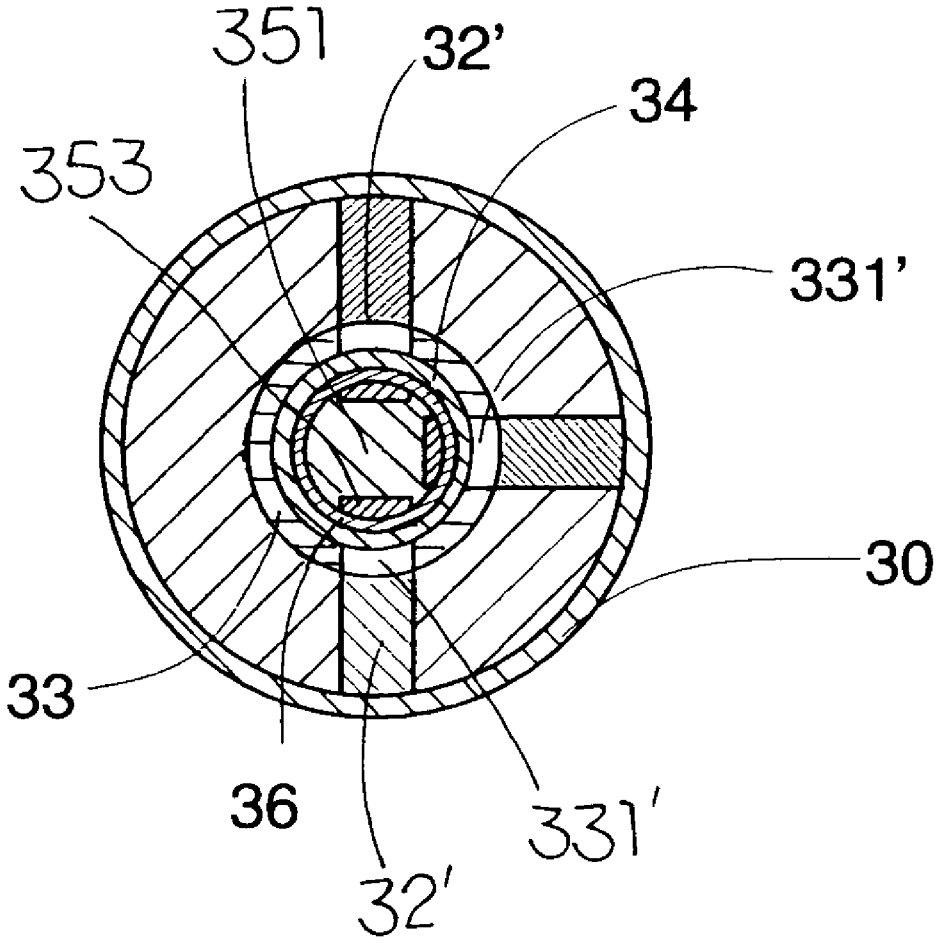
FIG. 5 is a sectional end view of the magnetic key lock assembly according to the above second preferred embodiment of the present invention.

Referring to FIGS. 3 and 4 of the drawings, a second preferred embodiment of the magnetic lock assembly 10' is illustrated, which basically has similar configuration as the above first embodiment. The locking holes 331' are only necessarily mounted on the rotor wall corresponded to the number of the magnet tumblers 32'. The magnetic lock assembly 10' further comprises a returning means, which further comprises a cap 41 having a diameter smaller than the diameter of the keyway 341' and a resilient element 42, which is a spring, inserting into the keyway 341'. The cap 41 is able to slide along the keyway 341' and comprises a cap body 411 wherein the resilient element 42 is adapted to be inserted and held therein, and a cap ring 412 outwardly and radially protruded from the bottom edge of the cap body 411 and adapted for preventing the cap 41 from sliding out of the keyway 341.

The resilient element 42 can be made of magnetic conducting material, so that when the cap 41 is bounded outwardly by the resilient element 42 within keyway 341', the resilient element 42 can also conduct all the magnet tumblers 32 to move inwardly to the locking position as shown in FIG. 4.

The returning means is normally positioned inside the keyway 341' as shown in FIG. 4. The resilient unit 42 will normally urge and retain the cap 41 toward the open end of the keyway 341' wherein the cap 41 will close the keyway 341' in order to prevent dust from outside for interfering and decreasing the magnetic field of the magnet lock assembly 10'. When the magnetic key is inserted into the keyway 341' of the magnetic lock assembly 10' as shown in FIG. 3, the resilient unit 42 of the blocking means is being compressed. If the user does not push and hold the magnetic key 35' into the keyway 341', the resilient unit 42 will rebound to its original position and automatically push the magnet key 35' out of the keyway 341'. So, the magnet key will not accidentally remain in the magnetic lock assembly 1O'.

The features of the first and second embodiments can be substituted for each other or modified as necessary.

Accordingly, for the mass production of the magnetic lock assembly 10 and the adequacy of the lock assembly industries, a maximum number of locking holes 331 are already radially distributed through a rotor wall of the lock rotor 33. Each magnet tumbler 32 can be selected with its pole and located at the locking hole 331. So, one mold of the lock rotor 33 is manufactured and is adapted for thousands of locking combinations by arranging the location and the pole of the magnet 353 in the lock cylinder 30.

Furthermore, a combination of the magnets 353 is preset in the magnet sockets 352 of the magnetic key, as shown in FIG. 1, for unlocking the corresponding combination of the magnet tumblers 32 in the magnetic lock assembly 10. So, if there are two lock assemblies, two different combinations of the magnets of the magnetic keys are needed. The user may need to carry numbers of keys to unlock the numbers of corresponding lock assemblies. Conveniently, the present invention provide a "master key" that all permutations and combinations of the magnet 353 are preset in one magnetic key 35 by combining the location and the pole of the magnets 353 set in the daughter keys and adapted for unlocking all the predetermined combination of lock assembly 10.

Moreover, the magnetic lock assembly 10 of the present invention provides more locking permutations and combinations to ensure the security function of a lock. For example, if there are four locking holes 331 on the rotor wall of the lock rotor 33 and each magnet tumbler 32 has two poles, so there are 16! (16*15*14* . . . *2*1) locking permutations and combinations for the magnetic lock assembly. As the number of the locking holes 331 increases, the more combinations are able to be set. The present invention provides more than 600,000 of the locking combination so that the probability of the same locking permutation and combination should be almost impossible.

What is claimed is:

1. A magnetic key lock assembly, comprising:

a magnetic lock cylinder for actuating a latch assembly, wherein said magnetic lock cylinder comprising a lock sleeve, made of non-magnetic material, having an axial rotor hole and a plurality of tumbler sockets radially distributed on an inner surface of said lock sleeve;

a plurality of magnet tumblers, each of which has a north pole and a south poll at two ends respectively, being coaxially placed in said tumbler sockets respectively, wherein each of said magnet tumblers must be equal to or shorter than said respective tumbler socket of said lock sleeve;

a tubular lock rotor, made of non-magnetic material, being rotatably and coaxially fitted in said axial rotor hole of said lock sleeve, said lock rotor having an axial through hole and a plurality of locking holes radially distributed through a rotor wall thereof, wherein said locking holes are able to be coaxially aligned with said tumbler sockets respectively and each of said locking holes has a depth shorter than a length of said respective magnet tumbler; and a locker tube, made of magnetic conducting material, being fittedly disposed inside said axial through hole of said lock rotor to define a keyway therethrough, wherein said locker tube is adapted for attracting said magnet tumblers inside said rotor hole to move inwardly towards said locking hole until an inner portion of each of said magnet tumblers is disposed in said respective locking hole and an outer portion of each of said magnet tumblers is disposed in said respective tumbler socket so as to lock up the rotatable movement between said lock rotor and said lock sleeve; and a magnetic key comprising a key body having a plurality of magnet sockets provided around said key body corresponding to axial and radial positions of said magnet tumblers in said magnetic lock cylinder respectively, and a plurality of pill shaped magnets affixed in said magnet sockets respectively, wherein an outer end of each of said magnets has a magnetic pole equal to a magnet pole of said respective magnet tumbler, wherein when said magnetic key is insert into said keyway, said magnet tumblers are repelled radially outward into said tumbler sockets correspondingly, so as to unlock said magnetic lock cylinder to enable said lock rotor to freely rotate to control the locking and unlocking of said latch assembly.

2. A magnetic key lock assembly, as recited in claim 1, wherein said magnetic key further comprises an exterior cover tube to securely and entirely cover said key body therein coaxially, so as to hide locations of all said magnets affixed on the magnet sockets from outside observation for security purpose.

3. A magnetic lock assembly, as recited in claim 1, wherein said magnetic lock assembly further comprises a locating groove provided on an open end of said lock rotor, and, correspondingly, a locating latch is outwardly protruded from an inner end of said key body of said magnetic key for fittingly engaging with said locating groove when said key body is inserted into said keyway for ensuring correct alignment of said magnets inside said magnetic key corresponding to said magnet tumblers in said magnetic lock cylinder.

4. A magnetic lock assembly, as recited in claim 2, wherein said magnetic lock assembly further comprises a locating groove provided on an open end of said lock rotor, and, correspondingly, a locating latch is outwardly protruded from an inner end of said key body of said magnetic key for fittingly engaging with said locating groove when said key body is inserted into said keyway for ensuring correct alignment of said magnets inside said magnetic key corresponding to said magnet tumblers in said magnetic lock cylinder.

5. A magnetic lock assembly, as recited in claim 1, wherein said magnetic lock assembly further comprises a returning means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway; and said returning means urges said magnetic key outwardly to prevent said key from remaining in said keyway.

6. A magnetic lock assembly, as recited in claim 2, wherein said magnetic lock assembly further comprises a returning means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway; and said returning means urges said magnetic key outwardly to prevent said key from remaining in said keyway.

7. A magnetic lock assembly, as recited in claim 3, wherein said magnetic lock assembly further comprises a returning means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway; and said returning means urges said magnetic key outwardly to prevent said key from remaining in said keyway.

8. A magnetic lock assembly, as recited in claim 4, wherein said magnetic lock assembly further comprises a returning means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway; and said returning means urges said magnetic key outwardly to prevent said key from remaining in said keyway.

9. A magnetic lock assembly, as recited in claim 5, wherein said magnetic lock assembly comprises a blocking means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway.

10. A magnetic lock assembly, as recited in claim 6, wherein said magnetic lock assembly comprises a blocking means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway.

11. A magnetic lock assembly, as recited in claim 7, wherein said magnetic lock assembly comprises a blocking means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway.

12. A magnetic lock assembly, as recited in claim 8, wherein said magnetic lock assembly comprises a blocking means, which includes a cap having a diameter smaller than the diameter of said keyway and a resilient unit normally urging and retaining said cap toward the open end of said keyway; said cap is able to slide along said keyway and comprises a cap body and wherein said resilient unit is adapted to be inserted and held therein, and a cap ring outwardly and radially protruded from the bottom edge of said cap body and adapted for preventing said cap from sliding out of said keyway.

* * * * *